US009410425B2

(12) United States Patent
Kim et al.

(10) Patent No.: US 9,410,425 B2
(45) Date of Patent: Aug. 9, 2016

(54) METHOD OF COLLECTING SAMPLE USING MULTI-PACKER AND APPARATUS THEREOF

(71) Applicant: KOREA INSTITUTE OF GEOSCIENCE AND MINERAL RESOURCES, Daejeon (KR)

(72) Inventors: Jeong-Chan Kim, Daejeon (KR); Ki-Sung Sung, Incheon (KR); Gi-Tak Chae, Yongin-si (KR); Byoung-Woo Yum, Daejeon (KR)

(73) Assignee: KOREA INSTITUTE OF GEOSCIENCE AND MINERAL RESOURCES, Daejeon (KR)

( * ) Notice: Subject to any disclaimer, the term of this patent is extended or adjusted under 35 U.S.C. 154(b) by 50 days.

(21) Appl. No.: 14/334,485

(22) Filed: Jul. 17, 2014

(65) Prior Publication Data

US 2015/0027696 A1 Jan. 29, 2015

(30) Foreign Application Priority Data

Jul. 24, 2013 (KR) ..... 10-2013-0087299

(51) Int. Cl.

| | |
|---|---|
| ***E21B 49/08*** | (2006.01) |
| ***E21B 33/12*** | (2006.01) |
| ***E21B 27/00*** | (2006.01) |
| ***E21B 47/00*** | (2012.01) |
| ***E21B 47/10*** | (2012.01) |

(52) U.S. Cl.

CPC ..... *E21B 49/081* (2013.01); *E21B 27/00* (2013.01); *E21B 33/12* (2013.01); *E21B 47/0002* (2013.01); *E21B 47/10* (2013.01)

(58) Field of Classification Search

CPC ..... E21B 49/10; E21B 49/08; E21B 33/1243; E21B 49/081; E21B 33/12; E21B 33/1277; E21B 4/18; E21B 49/084; E21B 49/088

See application file for complete search history.

(56) References Cited

U.S. PATENT DOCUMENTS

| | | | | |
|---|---|---|---|---|
| 2002/0066308 | A1* | 6/2002 | Shapiro | E21B 49/00 73/152.18 |
| 2010/0122822 | A1* | 5/2010 | Corre | E21B 49/08 166/387 |
| 2010/0258304 | A1* | 10/2010 | Hegeman | E21B 7/10 166/250.01 |

FOREIGN PATENT DOCUMENTS

| | | |
|---|---|---|
| JP | 5-77391 | 10/1993 |
| JP | 9-25783 | 1/1997 |
| JP | 5230576 | 3/2013 |
| KR | 10-2008-0104893 | 12/2008 |
| KR | 10-1144289 | 5/2012 |

* cited by examiner

*Primary Examiner* — Zakiya W Bates

(74) *Attorney, Agent, or Firm* — Lewis Roca Rothgerber Christie LLP

(57) ABSTRACT

A method of collecting samples that are not polluted at the outside of a borehole at a predetermined depth by using a multi-packer and an apparatus therefore. Contaminated water in the borehole between first and second packers of the multi-packer is selectively discharged into a contaminated water discharging vessel installed on a lower end of a sample collecting container by opening or closing an electronic switching valve in the contaminated water discharging vessel.

11 Claims, 9 Drawing Sheets

METHOD OF COLLECTING SAMPLE USING MULTI-PACKER AND APPARATUS THEREOF

CROSS-REFERENCE TO RELATED APPLICATION

This application claims the benefit under 35 U.S.C. §119 of Korean Patent Application No. 10-2013-0087299 filed on Jul. 24, 2013 in the Korean Intellectual Property Office, the entirety of which disclosure is incorporated herein by reference.

BACKGROUND OF THE INVENTION

1) Field of the Invention

The present invention relates to a method of collecting samples and an apparatus thereof, and more particularly, to a method of precisely collecting samples, which are not polluted, at the outside of a borehole at a predetermined depth by using a multi-packer, and an apparatus thereof.

2) Background of Related Art

Generally, underground water of landfill or a mass-burial site, underground water nearby nuclear generating plant or radioactive waste disposal facility, or underground water of a site storing $CO_2$, that is a major contributor to global warming, in the underground thereof has been variously contaminated due to leachate. In case of a $CO_2$ underground storage site, it has been known that the underground water contains a lot of $CO_2$ leaked from the $CO_2$ underground storage site.

In order to grasp the reality of the dispersal of underground water pollution or $CO_2$, after a borehole (tube well) is formed, a sample of underground water is collected at a predetermined depth such that the quality of underground water is measured.

In this case, the predetermined depth signifies the depth of 300 m or 500 m at which a sample of underground water is collected.

Thus, when samples are collected from the same borehole at each of the depths, this may signify that samples of underground water are collected at the predetermined depth.

Meanwhile, although various schemes of collecting samples of underground water have been proposed, when the sampling of underwater are repeatedly performed at a predetermined depth, a contaminant may be dispersed from the predetermined depth to the ground in the borehole, so that it may be difficult to grasp an exact water quality at the predetermined depth.

That is, while a sample collecting container is repeatedly dropped into and retrieved from a single borehole, the underground water filling the borehole is mixed up and down, so that the contaminants contained in the underground water may be dispersed up and down or the underground water may be changed in the concentrations of the contaminants such as $CO_2$ existing at concentrations changed according to the depth of the borehole.

Therefore, a method and apparatus for precisely collecting samples which are not contaminated at an outside of a borehole by avoiding the contamination due to mixing of contaminants (including $CO_2$) in the borehole at the predetermined depth have not been proposed yet.

As a related art of the present invention, there is Korea Unexamined Patent Publication No. 10-2008-0104893 entitled "Liquid Collecting Apparatus" (published on Dec. 3, 2008).

SUMMARY OF THE INVENTION

Therefore, an object of the present invention is to provide a method and an apparatus for collecting samples using multi-packer.

The present invention suggests several object(s) without limitation to the above object(s), and other object(s), which are not described, can be clearly comprehended from the following description by those skilled in the art.

To achieve the above-described object, according to an embodiment of the present invention, there is provided a method of collecting a sample using a multi-packer including (A) dropping a sample collecting container into a borehole to collect a sample; (B) confirming whether the dropped sample collecting container arrives at a predetermined depth; (C) allowing a first packer surrounding an outer portion of a top end of the sample collecting container and a second packer surrounding an outer portion of a bottom end of the sample collecting container to adhere closely to a wall of the borehole by expanding the first and second packers when the dropped sample collecting container arrives at the predetermined; (D) collecting the sample at an outside of a casing constituting the borehole; (E) separating the first and second packers from each other when the collecting of the sample is completed; and (F) retrieving the sample collecting container filled with the sample from the borehole.

According to another embodiment of the present invention, there is provided an apparatus of collecting a sample using a multi-packer including a sample collecting container dropped down into a borehole in order to collect a sample; a sample collecting cylinder adhering to an inner side of the sample collecting container; a sample collecting rod horizontally moveable in an extending direction of the sample collecting cylinder to protrude from the sample collecting cylinder and having a transferring path at an inside of the sample collecting rod to transfer the collected sample; a sample collecting part formed corresponding to the moving and protruding direction of the sample collecting rod moving to protrude from the sample collecting cylinder and formed at one side wall of a casing constituting the borehole; and a first packer adhering to and surrounding an outer portion of a top end of the sample collecting container and a second packer adhering to and surrounding an outer portion of a bottom end of the sample collecting container.

According to still another embodiment of the present invention, there is provided an apparatus of collecting a sample using a multi-packer including a sample collecting container dropped down into a borehole in order to collect a sample; a sample collecting cylinder adhering to an inner side of the sample collecting container; a sample collecting rod protruding from the sample collecting cylinder; a sample collecting part formed corresponding to the sample collecting rod protruding from the sample collecting cylinder and formed at one side wall of a casing constituting the borehole; a contaminated water discharging vessel installed to a lower end of the sample collecting container to discharge contaminated water in the borehole; and a first packer adhering to and surrounding an outer portion of a top end of the sample collecting container and a second packer adhering to and surrounding an outer portion of a bottom end of the contaminated water discharging vessel at a lower portion of the sample collecting container, wherein an electronic switching valve is formed in the contaminated water discharging vessel which is opened or closed to receive contaminated water between the first and second packers.

The details of other embodiments are described in the detailed description and shown in the accompanying drawings.

The advantages, the features, and schemes of achieving the advantages and/or features of the present invention will be apparently comprehended by those skilled in the art based on the embodiments, which are detailed later in detail, together with accompanying drawings. However, the present invention is not limited to the following embodiments but includes various applications and modifications. The embodiments will make the disclosure of the present invention complete, and allow those skilled in the art to completely comprehend the scope of the present invention. The present invention is only defined within the scope of accompanying claims.

In addition, the same reference numerals denote the same elements throughout the specification, and sizes, positions, and coupling relationships of the elements may be exaggerated for clarity.

As described above, according to the method and apparatus for collecting samples by using a multi-packer of the present invention, samples can be precisely collected at outside of a borehole at a predetermined depth by using the multi-packer.

In addition, according to the present invention, since the contaminated water in the borehole is not introduced into and mixed with the collected sample, desired samples can be precisely collected at a predetermined depth.

Figure 6:
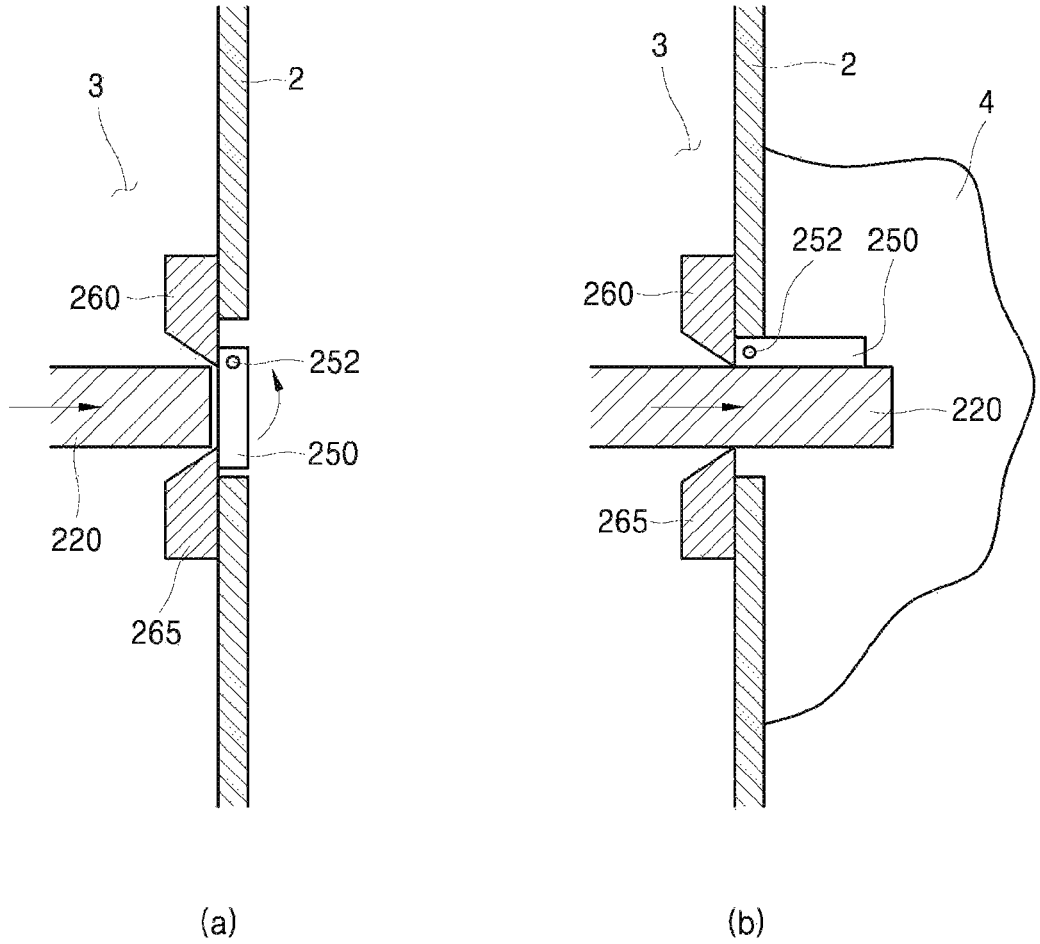

Parts (a) and (b) of FIG. 6 are sectional views schematically showing a sequence of coupling an apparatus for collecting a sample using a multi-packer to the sample collecting part of the wall of the borehole according to a preferable embodiment of the present invention.

Figure 7:
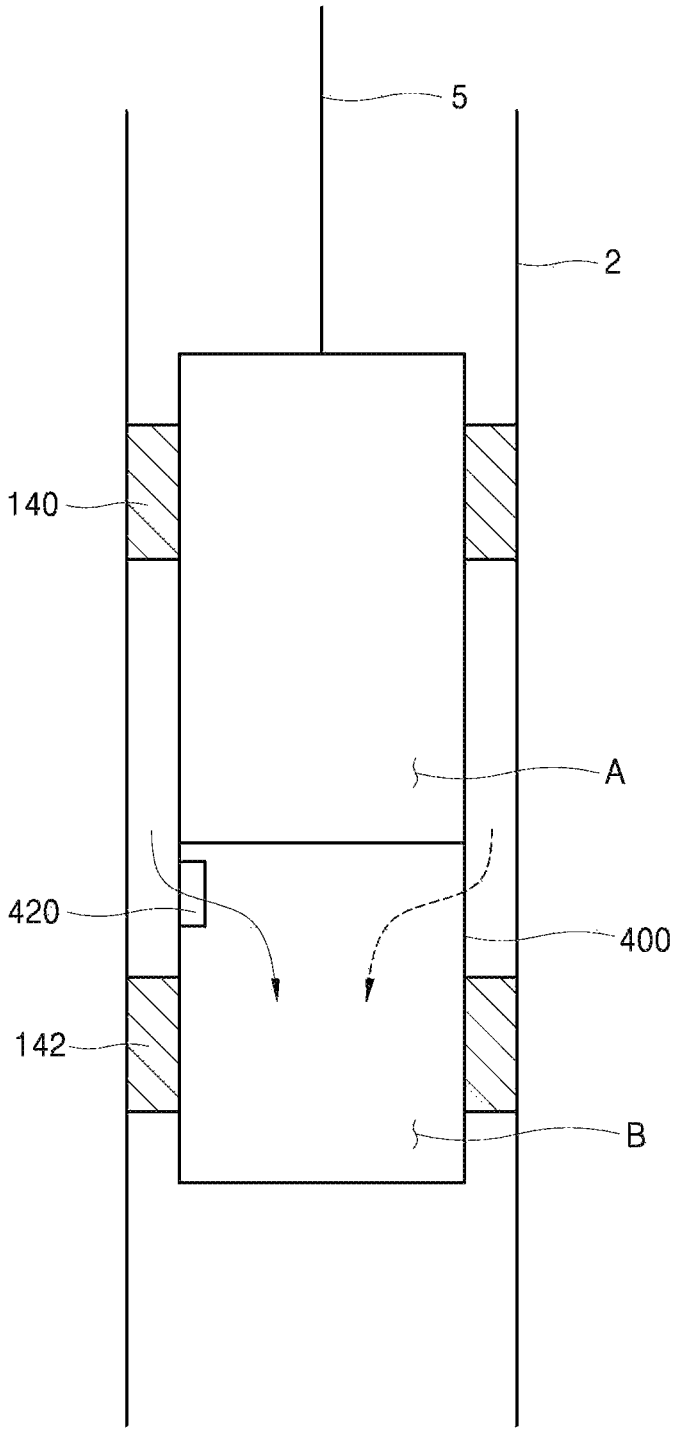

FIG. 7 is a schematic sectional view showing a structure of discharging the contaminated water between the packers in an apparatus for collecting a sample using a multi-packer according to a preferable embodiment of the present invention.

Figure 8:
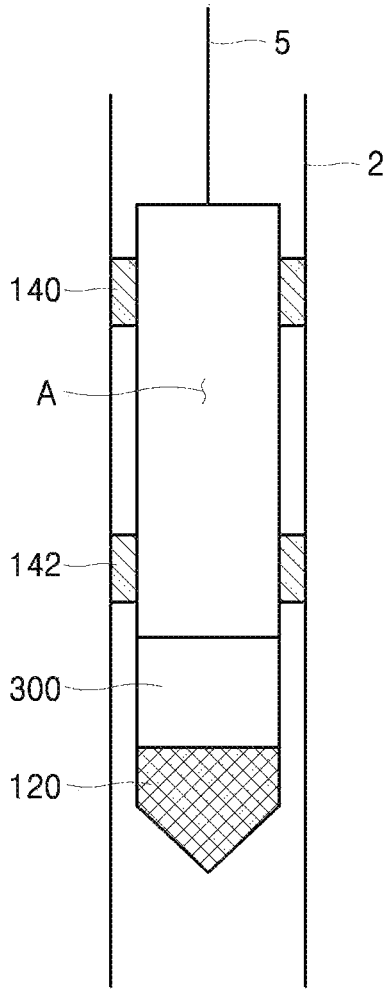

FIG. 8 is a schematic sectional view illustrating a mechanism of charging a packer by using nitrogen gas in an apparatus for collecting a sample using a multi-packer according to a preferable embodiment of the present invention.

Figure 9:
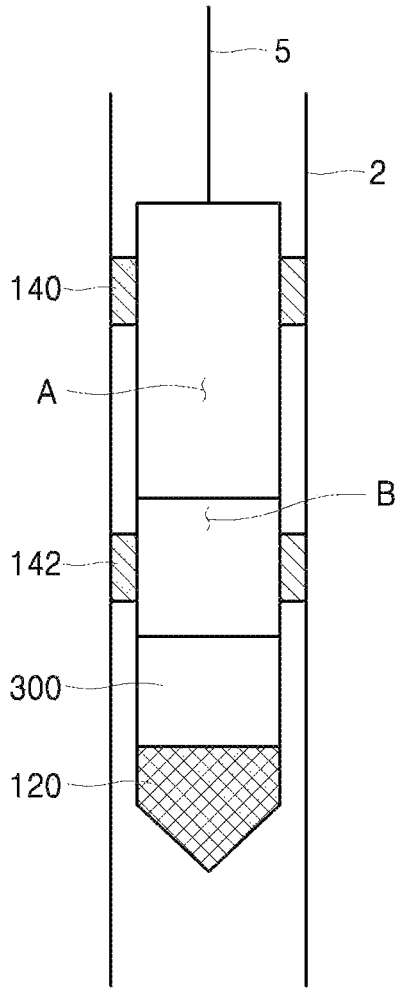

FIG. 9 is a schematic sectional view illustrating a mechanism of discharging the contaminated water between the packers and a mechanism of charging a packer in an apparatus for collecting a sample using a multi-packer according to a preferable embodiment of the present invention.

DETAILED DESCRIPTION OF THE INVENTION

Hereinafter, embodiments of the present invention will be described in detail with reference to accompanying drawings.

Figure 1:
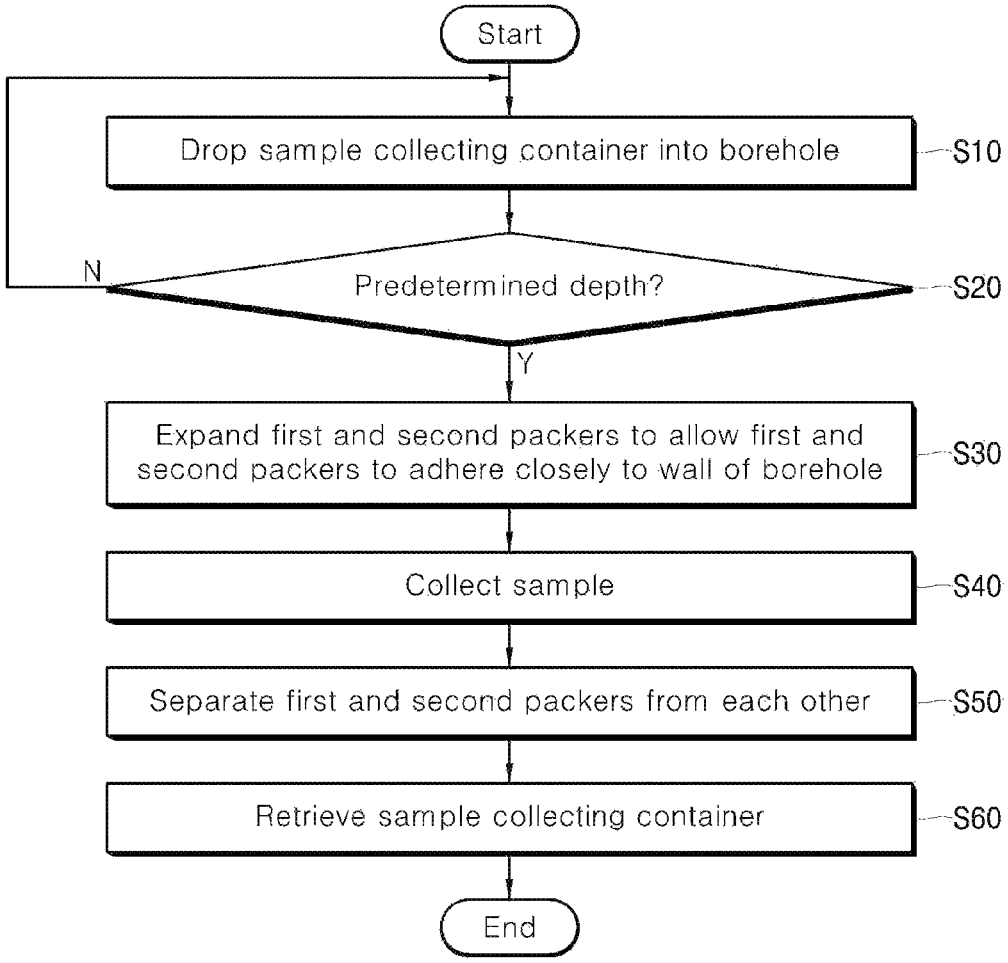
FIG. 1 is a flowchart schematically illustrating a method of collecting samples using a multi-packer according to an embodiment of the present invention.

FIG. 1 is a flowchart schematically illustrating a method of collecting samples using a multi-packer according to an embodiment of the present invention.

According to the present invention, a method of collecting a sample using a multi-packer may include a step S10 of dropping a sample collecting container into a borehole, a step S20 of confirming whether the sample collecting container dropped arrives at a predetermined depth, a step S30 of allowing a first packer and a second packer to adhere closely to a wall of the borehole by expanding the first and second packers when the sample collecting container dropped arrives at the predetermined depth, a step S40 of collecting the sample, a step S50 of separating the first and second packers from each other, and a step of S60 of retrieving the sample collecting container from the borehole.

First, the step S10 of dropping a sample collecting container into a borehole is performed to collect a sample of underground water at a predetermined depth.

The details about a shape or configuration of the sample collecting container will be described below with reference to FIGS. 2 to 9.

Next, the step S20 of confirming whether the sample collecting container dropped arrives at the predetermined depth is performed.

In this case, as described above, the predetermined depth may be changed according to various kinds of measurement conditions and ranges. For example, in case of a mass-burial site, the determined depth may be about 10 m, and in case of measuring the $CO_2$ concentration of underground water near the $CO_2$ underground storage site, the predetermined depth may be 300 m, 500 m or 1,000 m.

Meanwhile, although it is assumed in the present invention that underground water exists at the predetermined depth, it should be understood that the underground water may not exist at the inside of the borehole. That is, the borehole may be generally filled with underground water when the depth at which a sample is collected is very deep, but when the depth at which a sample is collected is relatively shallow, underwater may exist only at an outside of the casing constituting the borehole and may not exist in the bore hole.

In this case, the confirmation of whether the sample collecting container arrives at the predetermined depth may be performed through a camera. Preferably, the camera is fixed between an outside upper end of the sample collecting container, that is, a first packer and a rod (which will be described below) for collecting a sample.

Thus, while the sample collecting container is being dropped down, an operator may know that the sample collecting container arrives at the determined depth, based on the image transmitted from the camera.

To the contrary, the confirmation of whether the sample collecting container arrives at the predetermined depth may be performed based on a length of a rope released, which is attached to the top end of the sample collecting container.

However, in this case, since there is no way for an operator on the ground to know whether the sample collecting container arrives at the exact sample collecting position, it is better to confirm whether the sample collecting container arrives at the predetermined depth with reference to the image transmitted from the camera than to detect whether the sample collecting container arrives at the predetermined depth based on only the length of the rope.

Next, when the sample collecting container arrives at the predetermined depth, the step S30 of allowing the first and second packers to adhere closely to the wall of the borehole by expanding the first and second packers is performed.

In the step S30, the first and second packers attached to the top and bottom ends of the sample collecting container are expanded by using nitrogen gas, and the first and second packers adhere closely to the wall, that is, the casing of the borehole.

In the step S30, when the first and second packers adhere closely to the wall of the borehole, the underground water existing at the predetermined depth may be stagnated between the first and second packers.

As described above, since there is a strong possibility that the underground water stagnated between the first and second packers is contaminated, it is determined that the stagnated underground water is not suitable as a sample, so that it is preferable to collect a sample from the underground water existing at an outside of the casing constituting the borehole.

As one preferable example, a scheme of processing the stagnated underground water will be described below with reference to FIG. 7.

Next, in the step S40 of collecting a sample, in stat that the first and second packers adhere closely to the wall, that is, the casing of the borehole, as described above, a sample is collected from the underground water existing at an outside of the casing constituting the borehole.

In the step S40 of collecting a sample, a scheme of confirming an amount of a collected sample and another concrete mechanism of collecting a sample will be described below with reference to FIG. 3 to (a) and (b) of FIG. 6.

After the sample collection is completed in the step S40 of collecting a sample, the step S50 of separating the first and second packers from each other is performed.

In the step S50 of separating the first and second packers from each other, the nitrogen gas in the first and second packers expanded through the step S30 of allowing the first and second packers to adhere closely to the wall of the borehole by expanding the first and second packers is discharged.

When the nitrogen gas is discharged from the first and second packers, the first and second packers are modified from the expanded states to deflated states. When the first and second packers are deflated, the first and second packers are separated from the wall of the casing or the borehole. Then, a next step may be performed.

Lastly, in the step of S60 of retrieving the sample collecting container from the borehole, as described above, after the first and second packers are deflated, the sample collecting container is retrieved.

When the first and second packers are deflated, even though the sample collecting container is retrieved, anxiety about corrosion of the first and second packers with the casing wall of the borehole may be solved.

In order to extremely avoid damage or malfunction due to the corrosion of the first and second packers or the sample collecting container with the casing wall of the borehole, bumps for preventing a collision may be provided to the uppermost end and lowermost end of the sample collecting container, respectively.

In this case, heights of the bumps for preventing a collision are preferably set to be higher than those when the first and second packers sufficiently shrink.

As described above, the method of collecting a sample using a multi-packer according to the embodiment of the present invention has been substantially described. Hereinafter, an apparatus for collecting a sample using a multi-packer according to a preferable embodiment of the present invention will be described.

Figure 2:
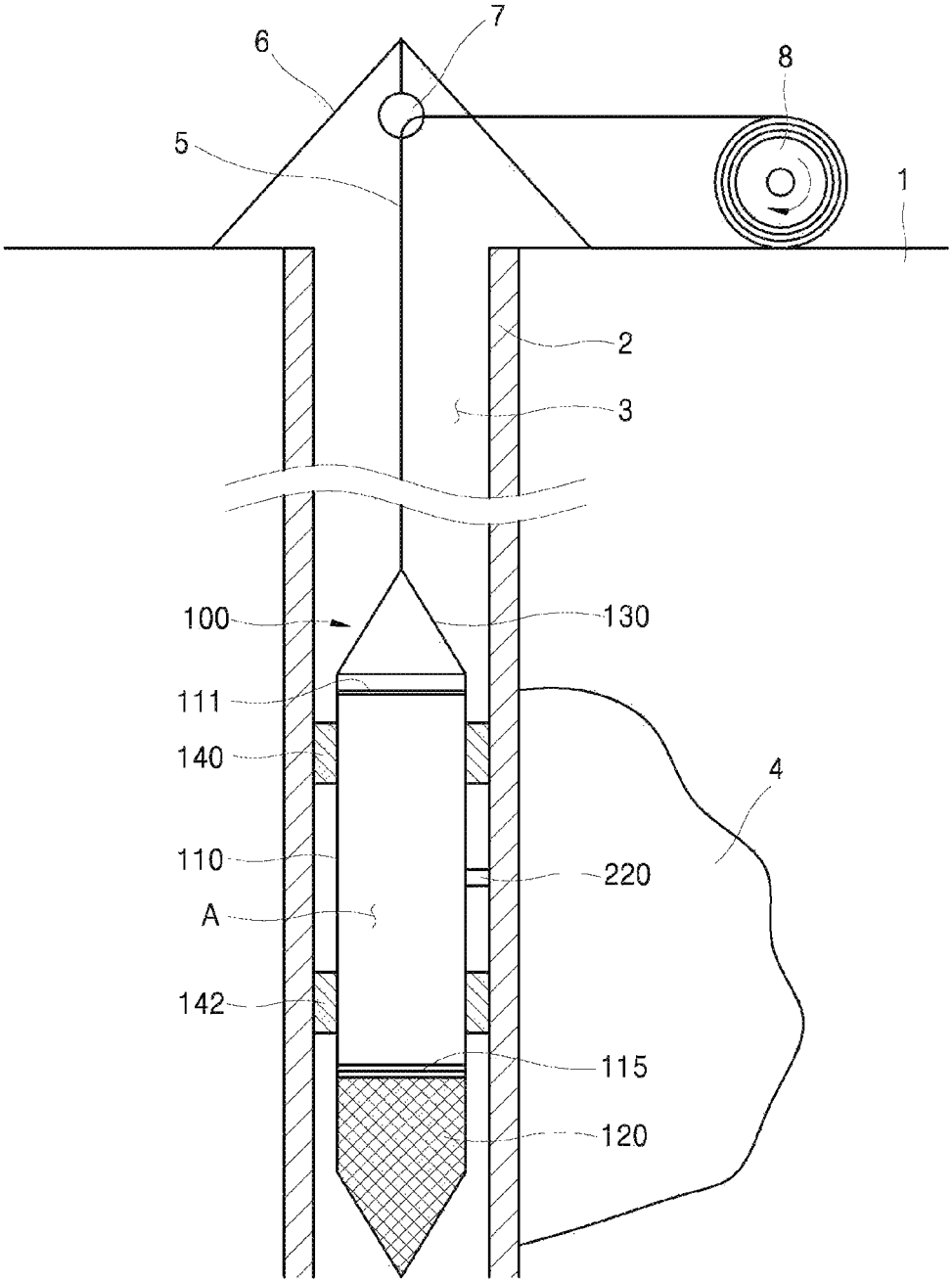
FIG. 2 is a vertical sectional view schematically showing an apparatus for collecting a sample using a multi-packer according to a preferable embodiment of the present invention.

FIG. 2 is a vertically sectional view schematically showing an apparatus for collecting a sample using a multi-packer according to the preferable embodiment of the present invention.

Referring to FIG. 2, the apparatus for collecting a sample using a multi-packer according to the preferable embodiment of the present invention includes a sample collecting container 100 dropped down into a borehole 3 formed by a casing 2.

The borehole 3 may be placed under a fixing support 6 fixed to a portion of the ground 1.

In this case, a rope 5 may be suspended on a rope hook 7, which is formed on a lower side of the fixing support 6, over the sample collecting container 100. The rope 5 may be wound on a hoist motor 8 spaced apart from the fixing support 6 by some distance in an arrow direction.

FIG. 2 shows the sample collecting container 100 which arrives and is fixed at a predetermined depth and the host motor 8 in state that the host motor 8 is not rotated.

Next, the configuration of the sample collecting container 100 will be described below.

The sample collecting container 100 is substantially divided into a main body 110, an upper side part 130 and a lower side part 120.

A first support 111 is fixed to a top end of the main body 110.

Several elements which may adhere to the first support 11 will be described with reference to FIG. 3.

The main body 110 has a sample collecting space A for collecting a sample 4, which may be preferably made to be vacuous before the sample collecting container is dropped down into the borehole 3.

In this case, the vacuum does not signify a high vacuum at a laboratory level. The pressure of the sample collecting space A in the main body 110 may be enough if the pressure is sufficiently less than that of an outside of the main body 110.

The reason of making the main body 110 in a vacuum state is to more rapidly collect a sample 4 of underground water. The sample 4 existing at a relatively higher pressure is rapidly introduced into the main body 110 having a relatively higher vacuum level.

Thus, it should be understood that there is no need to uselessly form a high vacuum in the main body 110.

The upper side part 130 corresponds to a head coupled to an upper portion of the main body 110. If necessary, components necessary to collect a sample may be installed in the upper side part 130.

As shown in the drawings, the upper side part 130 may additionally adhere to an outer portion of the main body 110. To the contrary, the upper side part 130 may be formed integrally with the main body 110.

Without regard to whether the upper side part 130 additionally adheres to the main body 110 or is formed integrally with the main body 110, preferably, the upper side part 130 has a funnel shape.

If the upper side part 130 is formed in a funnel shape, when the sample collecting container 100 is retrieved after the sample collection is completed, an additional merit of reducing resistance from the upper portion of the borehole 3 may be expected.

Then, the lower side part 120 is fixed to a lower portion of the main body 110. Preferably, the lower side part 120 is fixed through a coupling part 150.

The coupling part 150 may adopt a screw coupling or may use a clamp (not shown). For example, any configuration may be allowed for the coupling part 150 if the configuration allows the main body 110 and the lower side part 120 to be coupled to each other.

Preferably, the lower side part 120 may be a weight. When the lower side part 120 is a weight, the sample collecting container 100 may be more easily dropped down in the borehole. To the contrary, as shown in FIG. 8 described below, the lower side part 120 may further include a nitrogen gas supply tank. In this case, even through the nitrogen gas supply gas is further included, it is preferable not to omit the weight.

Preferably, the weight may include lead. When taking environment into consideration, the weight may be formed of a material except for lead.

Without regard to whether the lower side part 120 additionally adheres to the main body 110 or is formed integrally with the main body 110, preferably, the lower side part 120 has a funnel shape.

Similarly to the upper side part 130, if the lower side part 120 is formed in a funnel shape, when the sample collecting container 100 is dropped down in the borehole 3 to collect a sample, an additional merit of increasing a dropping speed from the lower portion of the borehole 3 may be expected.

Next, preferably, the sample collecting container 100 further includes the first packer 140 which adheres to an outside upper end of the main body 110 constituting the sample collecting container 100 while surrounding the outer portion of the upper end of the main body 110, and a second packers 142 which adheres to an outside lower end of the main body 110 constituting the sample collecting container while surrounding the outer portion of the lower end of the main body 110.

FIG. 2 shows a state that the sample collecting container 100 arrives at a predetermined depth and the first and second packers 140 and 142 adhere closely to the casing 2 of the borehole 3.

As described above, the confirmation of whether the sample collecting container 100 arrives at the predetermined depth may be performed through the camera (not shown) which is fixed to an outside upper end of the sample collecting container, that is, between a lower side of the first packer and the rod 220 for collecting a sample. Thus, while the sample collecting container 100 is being dropped down, an operator may confirm that the sample collecting container 100 arrives at the determined depth, based on the image transmitted from the camera.

In this case, the first and second packers 140 and may be expanded by using nitrogen gas supplied from the nitrogen gas supply tank (See FIG. 8). A mechanism of supplying nitrogen gas from the nitrogen gas supply tank will be described with reference to FIG. 8.

When the first and second packers 140 and 142 may be expanded by the nitrogen gas, as described above, contaminated water may exist between the first and second packers 140 and 142 and between the main body 110 and the casing 2 constituting the borehole 3.

To the contrary, although any contaminated water may not exist in the borehole 3 at the predetermined depth, the embodiment will be described based on the assumption that the borehole 3 is basically filled with contaminated water.

Since the contaminated water may include another component different from a component of the sample 4 desired to be collected, it is preferable that the contaminated water is processed separately from the sample 4.

In this case, a scheme of separating and processing the contaminated water will be described below with reference to FIG. 7.

As described above, when the main body 110 constituting the sample collecting container 100 is fixed through the first and second packers 140 and 142, the sample collecting rod 220 protrudes in a horizontal direction and arrives at a sample collecting part (not shown: see (a) and (b) of FIG. 6), so that the rod passes through the casing 2 to arrive at a sample. Then, the sample 4 may be collected through an inside of the rod 220.

To this end, a transferring path (not shown), which has a hollow shape, is preferably provided to an inside of the rod 220 for collecting a sample. In addition, preferably, a cover (not shown), which can be opened or closed to block contaminated water and selectively receive a sample, adheres to a front end of the rod 220 for collecting a sample.

The cover is closed while the sample collecting rod 220 moves in the contaminated water and then, the cover is opened after the rod 220 arrives at the sample 4. More preferably, the rod 220 is configured to supply the sample into the main body 110 along the transferring path described above.

Figure 3:
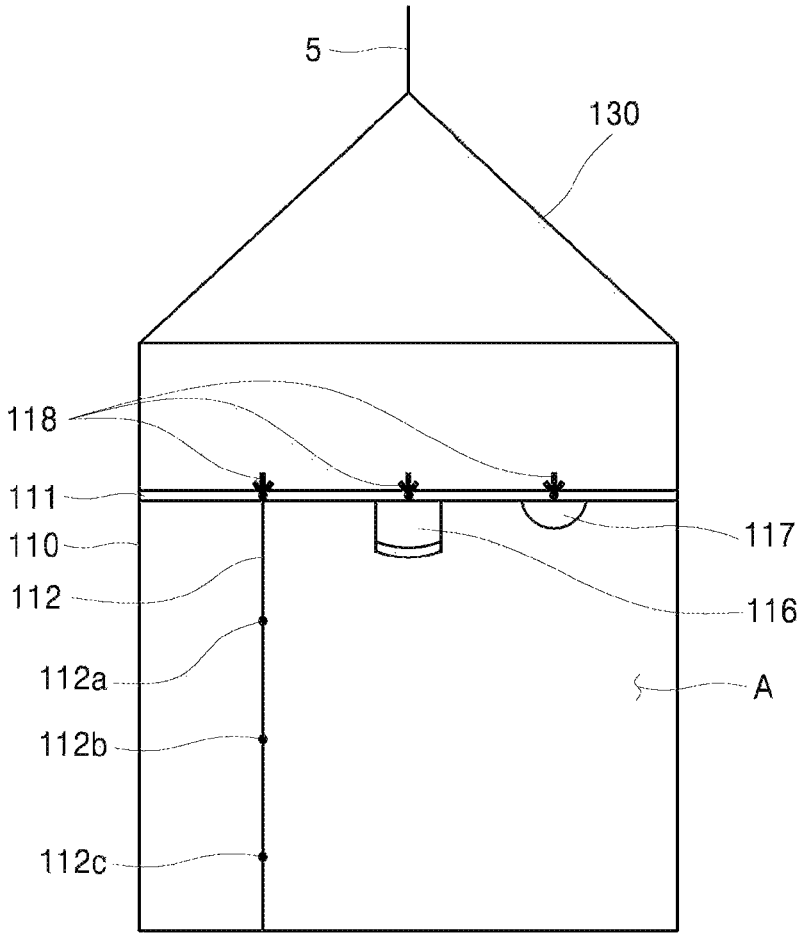
FIG. 3 is a sectional view schematically showing an inside of a sample collecting container of an apparatus for collecting a sample using a multi-packer according to a preferable embodiment of the present invention.

FIG. 3 is a sectional view schematically showing an inside of a sample collecting container of an apparatus for collecting a sample using a multi-packer according to a preferably embodiment of the present invention.

FIG. 3 shows the enlarged inside of the main body 110 of the sample collecting container 100, where the description about the same elements as those of FIG. 2 will be omitted.

Figure 4:
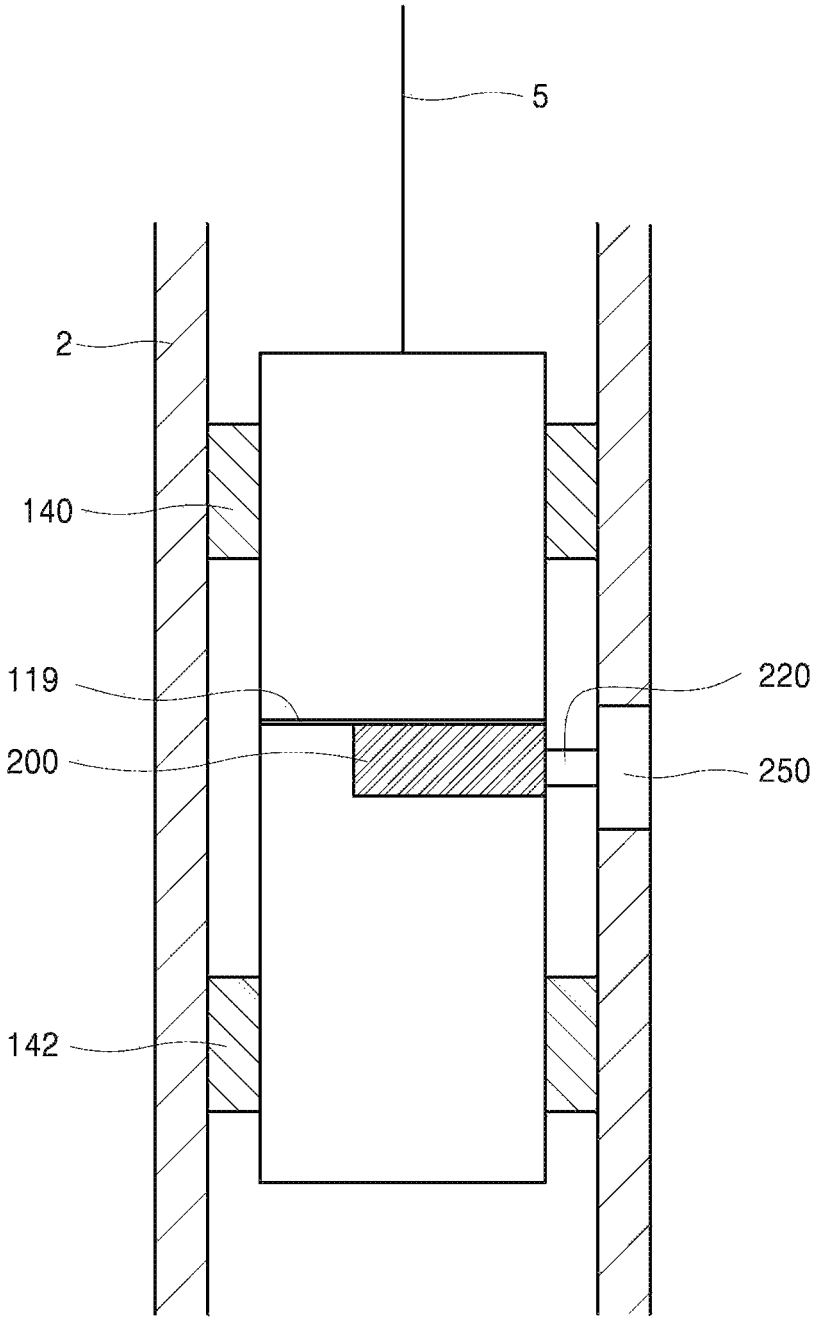
FIG. 4 is a sectional view showing a structure of a packer and a configuration of a cylinder in a sample colleting container of an apparatus for collecting a sample using a multi-packer according to a preferable embodiment of the present invention.

Referring to FIG. 4, it is known that a first support is formed on an inside top end of the main body 110.

For example, a water-level gauge for confirming how much the sample 4 is filled therein or the camera 117 for confirming an amount of the collected or charged samples 4 based on a photographed image is preferably installed to the first support 111.

More preferably, reference numeral 116 denotes a lighting apparatus for supporting the reliable operation of the camera 117.

In this case, the water-level gauge 112 may include an upper end water level sensor 112*a* for detecting an upper end water level, a middle water level sensor 112*b* for detecting a middle water level and a lower end water level sensor 112*c* for detecting a lower water level.

In this case, when a sample is filled to one of the sensors 112*a*, 112*b* and 112*c* installed at upper, middle and lower portions of the water level gauge 112, an operator on the ground may grasp the fact.

Differently from the above, the operator on the ground may grasp the water level of the sample 4 through an image from the camera 117.

Differently, although not shown, a contactless type water level gauge for detecting a water level, for example, through ultrasonic waves may be fixed to the firs support 111.

In this case, reference numeral 118 denotes a fixing device for fixing the water level gauge 112, the lighting apparatus 116 and the camera 117 to the first support 111.

FIG. 4 is a sectional view showing a structure of a packer and a configuration of a cylinder in a sample colleting container of an apparatus for collecting a sample using a multi-packer according to a preferable embodiment of the present invention.

Referring to FIG. 4, it is obviously understood that the first packer 140 surrounds and is fixed to the outer portion of the top end of the main body of the sample collecting container and the second packer 142 surrounds and is fixed to the outer portion of the bottom end of the main body of the sample collecting container.

As described above, the first and second packers 140 and 142 are expanded through the nitrogen gas supplied from the nitrogen gas supply tank (not shown).

In addition, referring to FIG. 4, the configurations of a second support 119 formed on a substantially central portion of the main body of the sample collecting container, a sample collecting cylinder 200 suspended on and adheres to the second support 119, and the rod 220 for collecting a sample, which horizontally protrudes from the sample collecting cylinder 200 in an extending direction of the sample collecting cylinder 200 and has a transferring path formed therein to transfer the collected sample through the transferring path, may be understood.

In addition, referring to FIG. 4, it may be understood that the sample collecting part is formed on one side wall of the casing 2 constituting the borehole 3 and formed corresponding to the protruding direction of the sample collecting rod 220 protruding from the sample collecting cylinder 200.

Hereinafter, the configuration of the sample collecting part will be described in detail with reference to (a) and (b) of FIG. 6.

FIG. 4 shows a state of the sample collecting rod 220 just before the rod 220 is introduced into the sample collecting part.

Figure 5:
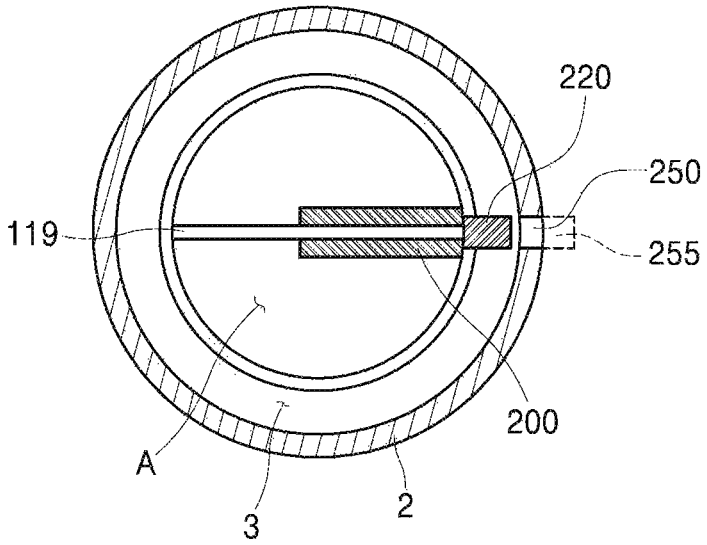
FIG. 5 is a sectional plan view showing a sample collecting container and a sample collecting part according to an embodiment of the present invention.

FIG. 5 is a sectional plan view showing a sample collecting container and a sample collecting part according to an embodiment of the present invention.

As shown in FIG. 5, a part of the sample collecting is formed on one side wall of the casing 2 constituting the borehole 3, the sample collecting cylinder 200 is suspended on the second support 119, and the sample collecting rod 220 horizontally protrudes from the sample collecting cylinder 200.

The detailed configuration of the sample collecting part of FIG. 5 will be described with reference to (a) and (b) of FIG. 6, but any samples are not shown in FIG. 5.

Referring to FIG. 5, it should be understood that the sample collecting cylinder 200 is formed corresponding to the sample collecting part.

The sample collecting rod 220 extends from the sample collecting cylinder 200 to allow the sample collecting part to be opened.

Reference numeral 255 denotes a position at which the rod 220 for collecting a sample allows the sample collecting part to be opened.

In this case, in order to configure the opening position 255 of the sample collecting part, a gate which is enabled to be opened and closed up and down may be preferably provided.

As shown in the drawings, the gate which is opened and closed up and down may be configured to be opened and closed in left and right directions. In addition, the gate may be opened and closed not only in one side direction, but also in both side directions such as a two-door gate.

Hereinafter, the configuration of the gate will be described with reference to (a) and (b) of FIG. 6.

Parts (a) and (b) of FIG. 6 are sectional views schematically showing a sequence of coupling an apparatus for collecting a sample using a multi-packer to the sample collecting part of the wall of the borehole according to a preferable embodiment of the present invention.

The sequence of coupling the sample collecting rod of the sample collecting cylinder 200 (not shown in FIG. 6), which protrudes from the apparatus for collecting a sample using a multi-packer according to one preferable embodiment of the present invention, to the wall of the borehole 3, that is, the sample collecting part formed in the casing 2 will be understood when referring to (a) and (b) of FIG. 6.

As shown in (a) of FIG. 6, the sample collecting rod extends by protruding from the sample collecting cylinder 200, so that the sample collecting part may approach the sample collecting part formed on the wall of the borehole 3.

Preferably, the sample collecting part of the casing includes the gate 250 enabled to be opened and closed up and down as the sample collecting rod 220 advances to the gate 250, such that the sample collecting rod 220 may pass through the gate 250.

In order to allow the gate 250 to be easily opened and closed in up and down directions, a rotation shaft 252 may be provided to an upper side of the gate 250.

In addition, the sample collecting part of the casing may further include upper and lower side guide blocks 260 and 265 for guiding the sample collecting rod 220 to allow the sample collecting rod 220 to be easily introduced into the gate 250.

In this case, preferably, as shown in the drawings, the upper and lower guide blocks 260 and 265 may have inclined side surfaces to allow the sample collecting rod to be easily guided.

At the same time, one of the inclined side surfaces is opened in the introducing direction of the sample collecting rod 220. In other words, when the sample collecting rod 220 is introduced from left to right on the drawing, the upper and lower side guide blocks 260 and 265 are formed to be '>'-shaped and to the contrary, when the sample collecting rod 220 is introduced from right to left on the drawing, the upper and lower side guide blocks 260 and 265 are formed to be '<'-shaped.

Next, referring to FIG. 6, the sample collecting rod may continuously move even when the gate 250 is fully pushed by the sample collecting rod 220 to the maximum opening position, so the sample collecting rod 220 extends beyond the maximum opening position of the gate 250.

The above configuration is necessary to restrain inevitable contaminated water as possible. Since the sample collecting rod 220 moves by passing through contaminated water as described above, contaminated water may inevitably exist when the sample collecting rod 220 is located under the gate 250.

In detail, since the constant water pressure is applied to the sample 4 at the underground in (b) of FIG. 6, it is assumed that the sample 4 actually exists under the same pressure as the contaminated water in the borehole 3.

Thus, when the sample collecting rod 220 advances while passing through the contaminated water, some contaminated water may exist in the vicinity of a front end of the sample collecting rod 220, so the above configuration is provided to exclude in inevitable contaminated water.

Preferably, the upper and lower guide blocks 260 and 265 may be formed of an elastic material, which can prevent the upper and lower guide blocks 260 and 265 from being corroded by underground water, such as natural rubber, synthetic rubber or synthetic plastic having rich elasticity.

FIG. 7 is a schematic sectional view showing a structure of discharging the contaminated water between the packers in an apparatus for collecting a sample using a multi-packer according to a preferable embodiment of the present invention.

Referring to FIG. 7, a structure of discharging the contaminated water between the first and second packers 140 and 142, that is, a structure of discharging the contaminated water into a contaminated water discharging vessel 400 provided to a lower portion of the main body of the sample collecting container may be understood.

In this case, preferably, an electronic switching valve 420 may be installed to one side of the contaminated water discharging vessel 400. Although the electronic switching valve 420, which is installed only to the one side of the contaminated water discharging vessel 400, is depicted in FIG. 7, in order to more rapidly discharge the contaminated water, two electronic switching valves may be installed to both sides of the contaminated water discharging vessel 400.

Electronic switching valves 420 may be installed at both sides of the contaminated water discharging vessel 400, and this situation may be recognized by a solid-line arrow shown on the left side of the drawing and a dot-line arrow shown on the right side of the drawing.

In this case, the electronic switching value 400 is preferably installed to an upper side of the second packer 142. Thus, the contaminated water between the first and second packers 140 and 142 may be easily discharged to not the sample collecting space A but a sample discharging space B.

As shown in FIG. 7, the sample collecting container and the contaminated water discharging vessel 400 are formed integrally with each other.

As described above, similarly to the sample collecting space A, the contaminated water discharging vessel 400 depicted in FIG. 7 is made to be vacuous.

Similarly to the scheme of easily collecting a sample into the sample collecting space A, the contaminated water may be enabled to be easily discharged into the contaminated water discharging vessel 400.

FIG. 8 is a schematic sectional view illustrating a mechanism of charging a packer by using nitrogen gas in an apparatus for collecting a sample using a multi-packer according to a preferable embodiment of the present invention.

A mechanism of charging a multi-packer according to a preferable embodiment of the present invention will be described with reference to FIG. 8.

According to the method of charging the multi-packer and 142 of a preferable embodiment of the present invention, the multi-packer 140 and 142 is charged and expanded by using nitrogen gas.

Preferably, as shown in FIG. 8, the nitrogen gas is charged into the nitrogen gas supply tank 300. In addition, preferably, the nitrogen gas is supplied through a nitrogen gas supply pipe, which is not shown, from the nitrogen gas supply tank 300 to the first and second packers 140 and 142.

In this case, preferably, the nitrogen gas supply pipe is connected from the nitrogen gas supply tank 300 to the first and second packers 140 and 142 through the sample collecting space A, that is, an inner space of the sample collecting container.

As shown in FIG. 8 and described above, a weight preferably serves as the lower side part. More preferably, bumps are formed on the outer portions of the upper side part of the sample collecting container to protrude to an outside of the sample collecting container and the lower side part of the weight, respectively, so that the first and second packers 140 and 142 may be prevented from being damaged while moving.

FIG. 9 is a schematic sectional view illustrating a mechanism of discharging the contaminated water between the packers and a mechanism of charging a packer in an apparatus for collecting a sample using a multi-packer according to a preferable embodiment of the present invention.

As shown in FIG. 9, an apparatus for collecting a sample using a multi-packer according to another preferable embodiment of the present invention includes a sample collecting space A, a contaminated water discharging space B, a nitrogen gas supply tank 300 and a lower side part 120, that is, a weight configuration.

In this case, although the positions of the contaminated water discharging space B and the nitrogen gas supply tank 300 may be changed with each other, it is preferable to set the positions of the sample collecting space a and the lower side part 120 as shown in FIG. 9.

As shown in FIG. 9, when the sample collecting container arrives at the predetermined depth, the nitrogen gas is supplied from the nitrogen gas supply tank 300 to the first and second packers 140 and 142, so that the first and second packers 140 and 142 are expanded, thereby fixing the sample collecting container onto the wall of the casing 2. Then, the contaminated water in the borehole 3 is discharged into the contaminated water discharging space B and then, the sample, which is collected through the sample collecting rod 220 protruding from the sample collecting cylinder 200, is collected into the sample collecting space A.

As described above, an amount of the collected sample, that is, an amount of the charged sample may be confirmed through a water level sensor or an optical processing device such as a camera. If the sample collecting is completed, the rope 5 is pulled up from the ground, so that the sample collecting container may be lastly retrieved.

As described above, the contaminated water in the borehole 3 is perfectly excluded so that only an uncontaminated sample outside the casing 2 can be collected.

In addition, the multi-packer can be fixed by using nitrogen gas, so that a sample can be precisely collected at a predetermined depth.

As described above, although various examples have been illustrated and described, the present disclosure is not limited to the above-mentioned examples and various modifications can be made by those skilled in the art without departing from the scope of the appended claims. In addition, these modified examples should not be appreciated separately from technical spirits or prospects. Therefore, it should be understood that the present invention is not limited to the embodiments described above. The scope of the present invention will be limited by the appended claims. In addition, it will also be apparent to those skilled in the art that variations or modifications from the appended claims and the equivalent concept of the claims are included in the scope of the present invention.

What is claimed is:

1. A method of collecting a sample using a multi-packer, the method comprising:

(A) dropping a sample collecting container into a borehole to collect a sample;

(B) confirming whether the dropped sample collecting container arrives at a predetermined depth;

(C) allowing a first packer surrounding an outer portion of a top end of the sample collecting container and a second packer surrounding an outer portion of a bottom end of the sample collecting container to adhere closely to a wall of the borehole by expanding the first and second packers when the dropped sample collecting container arrives at the predetermined depth;

(D) collecting the sample at an outside of a casing constituting the borehole;

(E) separating the first and second packers from the wall of the borehole when the collecting of the sample is completed;

(F) retrieving the sample collecting container filled with the sample from the borehole; and (G) selectively discharging contaminated water in the borehole between the first and second packers into a contaminated water discharging vessel installed on a lower end of the sample collecting container by opening or closing an electronic switching valve in the contaminated water discharging vessel.

2. The method of claim 1, wherein, in task (C) the expansion of the first and second packers is performed through nitrogen gas supplied from a nitrogen gas supply tank formed on the lower end of the sample collecting container.

3. The method of claim 1, wherein, in task (B), the confirming of whether the sample collecting container arrives at the predetermined depth is performed through a camera.

4. The method of claim 1, whether the task (G) of discharging the contaminated water between the first and second packers into the contaminated water discharging vessel on the lower end of the sample collecting container is performed before task (D).

5. The method of claim 1, wherein task (D) includes a task of collecting the sample at the outside of the casing constituting the borehole in the sample collecting container at the predetermined depth by allowing a sample collecting rod of a cylinder installed at an inside of the sample collecting container to protrude in a horizontal direction, which is an extending direction of the cylinder, by way of an openable gate formed in a sample collecting part provided at the wall of the borehole.

6. An apparatus of collecting a sample using a multi-packer, the apparatus comprising:

a sample collecting container dropped down into a borehole in order to collect a sample;

a sample collecting cylinder adhering to an inner side of the sample collecting container;

a sample collecting rod protruding from the sample collecting cylinder;

a sample collecting part formed corresponding to the sample collecting rod protruding from the sample collecting cylinder and formed at one side wall of a casing constituting the borehole;

a contaminated water discharging vessel installed to a lower end of the sample collecting container to discharge contaminated water in the borehole; and a first packer adhering to and surrounding an outer portion of a top end of the sample collecting container and a second packer adhering to and surrounding an outer portion of a bottom end of the contaminated water discharging vessel at a lower portion of the sample collecting container, wherein an electronic switching valve is formed in the contaminated water discharging vessel which is opened or closed to receive contaminated water between the first and second packers.

7. The apparatus of claim 6, wherein the sample collecting part formed at the one side wall of the casing includes:

a guide block for guiding the sample collecting rod protruding from the sample collecting cylinder to allow the sample collecting rod to precisely collect a sample; and a gate opened or closed to allow the sample collecting rod protruding from the sample collecting cylinder to be introduced into the gate.

8. The apparatus of claim 6, further comprising a nitrogen gas supply tank formed on a lower portion of the sample collecting container to expand the first and second packers by supplying nitrogen gas to the first and second packers.

9. The apparatus of claim 6, further comprising at least one of a water level sensor for measuring an amount of a collected sample and a camera for photographing the amount of the collected sample in the sample collecting container.

10. The apparatus of claim 6, further comprising a camera installed between a lower side of the first packer and the sample collecting rod to monitor a coupling of the sample collecting rod to the sample collecting part.

11. The apparatus of claim 6, wherein the sample collecting cylinder is fixed to a support formed at an inside of the sample collecting container in a horizontal direction.

* * * * *